US008465169B2

(12) United States Patent
Lin

(10) Patent No.: US 8,465,169 B2
(45) Date of Patent: Jun. 18, 2013

(54) DRIVING SHAFT MECHANISM FOR RATCHET WRENCH

(76) Inventor: Hung-Wen Lin, Taichung (TW)

( * ) Notice: Subject to any disclaimer, the term of this patent is extended or adjusted under 35 U.S.C. 154(b) by 303 days.

(21) Appl. No.: 12/960,575

(22) Filed: Dec. 6, 2010

(65) Prior Publication Data

US 2012/0140453 A1 Jun. 7, 2012

(51) Int. Cl.
*B25B 23/18* (2006.01)
*B21K 5/00* (2006.01)

(52) U.S. Cl.
USPC ..... 362/119; 362/109; 362/120; 76/114; 76/119

(58) Field of Classification Search
USPC ..... 362/109, 119, 120; 76/114, 119
See application file for complete search history.

(56) References Cited

U.S. PATENT DOCUMENTS 5,647,252 A * 7/1997 Miner ..... 81/62
6,527,404 B2 * 3/2003 Wang ..... 362/119

* cited by examiner

*Primary Examiner* — Evan Dzierzynski
*Assistant Examiner* — Danielle Allen

(57) ABSTRACT

A driving shaft mechanism for a ratchet wrench is disclosed. The driving shaft mechanism is built as a spindle assembly of the ratchet wrench and has a lighting device for offering direct lighting to an operating area of the ratchet wrench. The spindle assembly prevents the lighting from being accidentally turned off when a user operates the ratchet wrench by virtue of screwing or unscrewing motions between a spindle cap and a containing part so as to allow the spindle cap to movably press on or depart from a switch controlling a switching circuit electrically connected with a lamp, and further to create a close circuit or an open circuit of the switching circuit, thus turning on or off the lamp.

8 Claims, 6 Drawing Sheets

DRIVING SHAFT MECHANISM FOR RATCHET WRENCH

BACKGROUND OF THE INVENTION

1. Technical Field

The present invention relates to hand tools, and more particularly, to a driving shaft mechanism designed for a ratchet wrench and having a lighting device therein.

2. Description of Related Art

Conventionally, when using a ratchet wrench to assemble or disassemble fixing elements in dark or under conditions of poor illumination, a user needs to hold a light in one hand while a hand tool in the other for lighting up an operating area. However, it is indeed troublesome if it takes both hands to operate in assembling or disassembling tasks. That means the user needs to install the light in a proper place and keep the light directed to the operating area during assembling or disassembling tasks.

For overcoming aforesaid shortcomings, some has developed hand tools integrated with a lighting device, as indicated in a number of prior arts. For example, Taiwan Utility Model Patent No. 287727 discloses a lighting device built in a grip of a hand tool to present downward a light beam. Another two prior arts, Taiwan Utility Model Patent Nos. 194208 and 181988, have a lighting device set within a grip of a hand tool and the light emits toward a working end of the hand tool. Still another Taiwan Utility Model Patent No. 189542 has a lighting device set outside a grip of a hand tool with its light cast toward a working end of the hand tool.

As discussed above, said prior arts do not have the light cast directly onto an operating area, thus leaving the operating area dark for the purpose of operation or bring shadowed by a user's hand or anything else between the light source and the operating area.

In yet another prior art, Taiwan Utility Model Patent No. 151015, a lighting unit established at a working end of a ratchet wrench provides direct lighting toward an operating area of the ratchet wrench. Unfortunately, it is uneconomic to build such a lighting unit inside a metal ratchet spindle due to a highly increased cost resulting from an additional drilling process to make a spindle bore in the spindle for accommodating the lighting unit. In addition, the lighting unit composed of a lamp, an electric pin and an electric conductor slackly positioned in the spindle bore is likely to have its components loosening, thereby causing poor connection.

In sum, during operating aforesaid ratchet wrench, an accidental switch-off of the lighting device or unit caused by the user's hands or other articles may easily occur and result in danger because the lighting device or unit is triggered by a simple slide or rotation to a switch correspondingly controlling the lighting device or unit. In addition, the operating area may not be fully covered by the light emitting from the lighting device, and an expensive cost and a technically challenging installation may attribute to complicated structure or excess parts.

SUMMARY OF THE INVENTION

To overcome the shortcomings of the traditional hand tools in terms of their lighting structures, the present invention provides a solution of installing a lighting device on a hand tool, in particular a ratchet wrench, at an working end of the ratchet wrench for generating and directing light to an operating area under a user's control. The hand tool of the present invention is characterized in simple parts and easy installation.

Referring to the accompanying drawings, the present invention includes a driving shaft mechanism built as a spindle assembly of the ratchet wrench, wherein the spindle assembly comprises a shaft, a spindle, a spring, at least one battery, a spindle cap, and a switch.

The shaft has a through hole therein. The spindle is set within the through hole, wherein the spindle comprises a post having a lamp and two electric pins attached to the lamp, and a hollow containing part that has an open end opposite to the post and a conductive recess dented on one side wall of the containing part for accommodating a switching circuit therein. The electric pins are electrically connected to an inner bottom of the containing part and to the switching circuit respectively.

The spring is sleeved outside the post and retained in the through hole for providing a resilient force to the spindle.

The battery is equipped in the containing part and has one electrode electrically connected with the electric pin positioned and connected to the inner bottom of the containing part.

The spindle cap is axially mounted with the containing part, and the spindle cap exposes atop the shaft when it is nonuse, but is capable of screwing with the open end of the containing part.

The switch provided between atop the open end of the containing part and an interior of the spindle cap is electrically connected between the switching circuit and the other electrode of the battery. As a screwing or unscrewing motions between the spindle cap and the containing part, the interior of the spindle cap is pressed or released so as to trigger the switch and therefore creating a close circuit or an open circuit of the switching circuit.

The implementation of the present invention can achieve at least following objectives.

The most important objective of the present invention is to provide the light direct to the operating area without being blocked by any obstacles by virtue of installing the lighting device in the spindle assembly to the ratchet wrench. In addition, the present invention takes advantage of screwing and unscrewing motions between the spindle cap and the containing part controlling the switch that is able to create the close circuit or open circuit of the switching circuit so as to turn on or cut off the lamp. Therefore, during operating the ratchet wrench, the switch will not be turned off accidentally.

Another objective of the present invention is to provide a ball recess at one side wall of the post for accommodating a ball, wherein the shaft has a positioning hole corresponding to the ball. In cooperation with the spring giving a resilient force to the spindle, the ball recess allows a user to attach or detach tool items such as a hushing at ease. Furthermore, since the lamp is supplied within the spindle, the present invention is applicable for avoiding any interference caused by installing a circuit.

Another objective of the present invention is to offer the spindle that is made of a plastic material and is convenient for integral forming, thus avoiding additional cutting and drilling processes necessary for a metal material. Optionally, the spindle can also be made by a transparent or light-transmitting material for constructing a lens structure at one end of the spindle so as to change lighting distribution produced by the lamp. Otherwise, the spindle taking advantage of light refraction allows a fully light-transmitting effect for illuminating an indicator on the spindle cap.

BRIEF DESCRIPTION OF THE DRAWINGS

The novel features believed characteristic of the invention are set forth in the appended claims. The invention itself, however, as well as a preferred mode of use, further objectives and advantages thereof, will be best understood by reference to the following detailed description of an illustrative embodiment when read in conjunction with the accompanying drawings, wherein:

FIG. 5 shows another cross-section view of the driving shaft mechanism in the present invention when a lighting device is turned on, and FIG. 6 is another cross-section view of the driving shaft mechanism in the present invention when the lighting device is turned on.

DETAILED DESCRIPTION OF THE PREFERRED EMBODIMENT

For the convenience of explanation of the concept of subject matter in the present invention, herein a preferred embodiment is disclosed. It is noted that all objects contained in the embodiment are described in an appropriate ratio, scale, deformation or displacement quantities applicable to the scope of explanation purpose rather than the ratio of any actual elements of the present invention.

Figure 1:
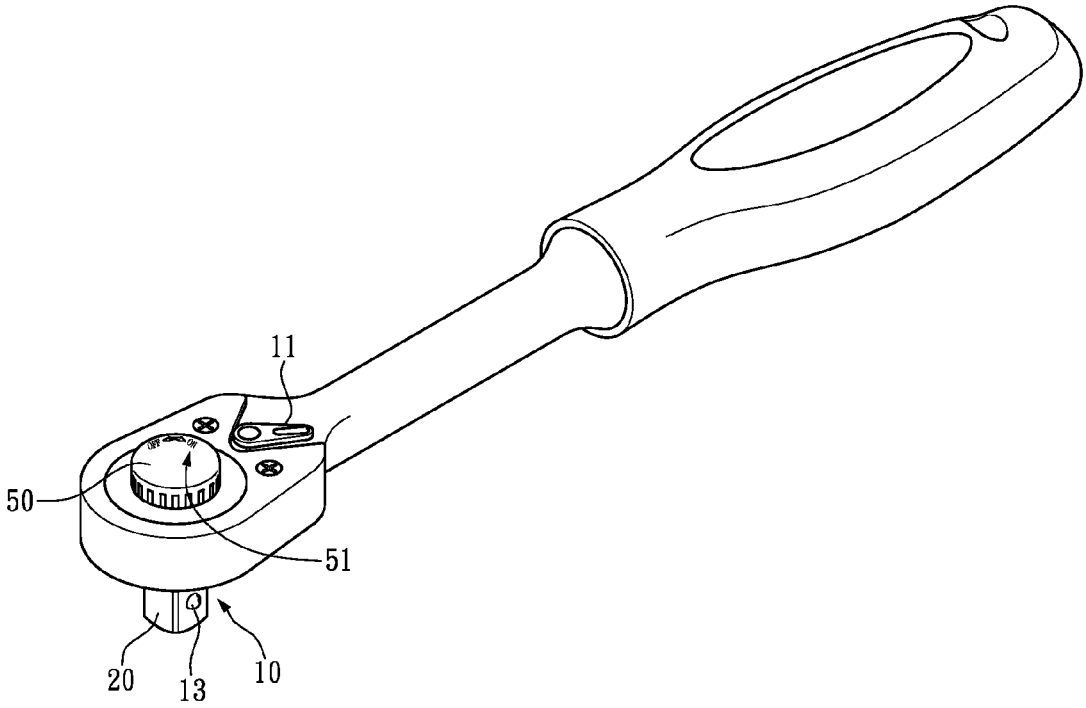
FIG. 1 is a perspective view of a driving shaft mechanism applied in a ratchet wrench according to the present invention.

FIG. 1 is a perspective view of the driving shaft mechanism applied in the ratchet wrench according to the present invention. Therein, the driving shaft mechanism is built as s a spindle assembly 10 composed of a shaft 20, a spindle 30, a spring 40, a spindle cap 50 and a switch 60. The configurations and functions of said elements are set forth in the following paragraphs.

The ratchet wrench has the spindle assembly 10 and an orienting bar 11 equipped at one working end thereof. The orienting bar 11 controls an orienting structure built in the working end, thus allowing a user to operate the ratchet wrench in a clockwise or counterclockwise direction and accordingly driving the spindle assembly 10 to rotate. However, when the user operates the ratchet wrench in a reverse direction, the spindle assembly 10 idles. The spindle assembly 10 further comprises the shall 20 which has a retrievable ball 13 movably provided at one lateral of the shaft 20. The ball 13 has a protruding portion exposing atop the lateral, and the protruding portion is engaged with an interior wall of a bushing sleeved with the shaft 20 for fixing the bushing and the shall 20 firmly.

Figure 2:
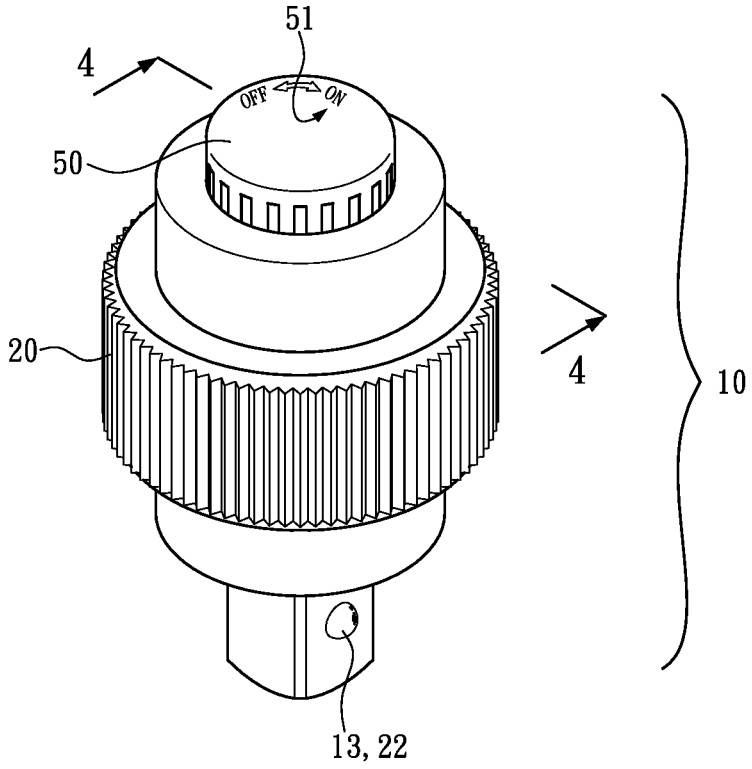
FIG. 2 is a perspective view of the assembled driving shaft mechanism in the present invention.
Figure 3:
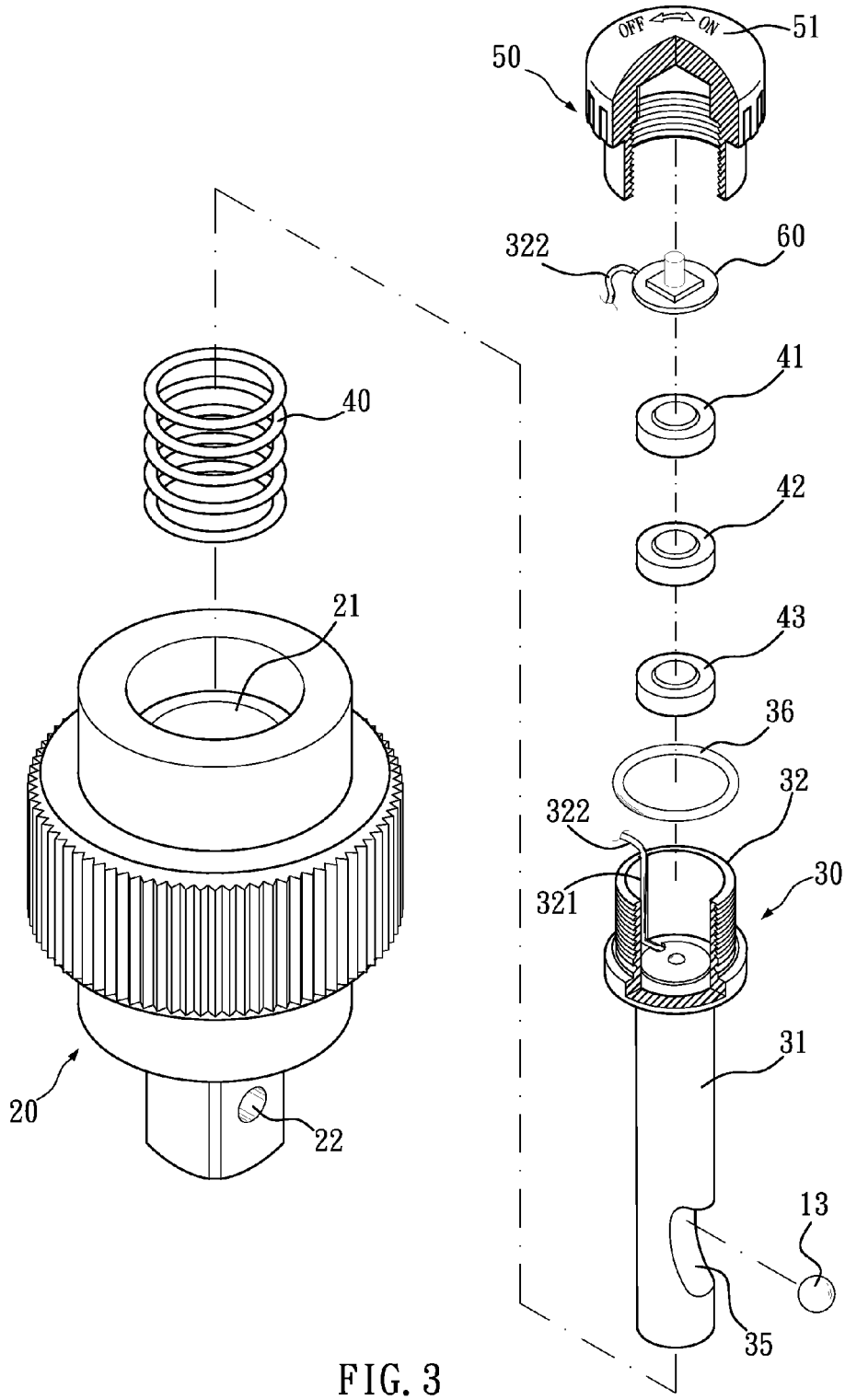
FIG. 3 is an exploded view of the driving shaft mechanism in the present invention.
Figure 4:
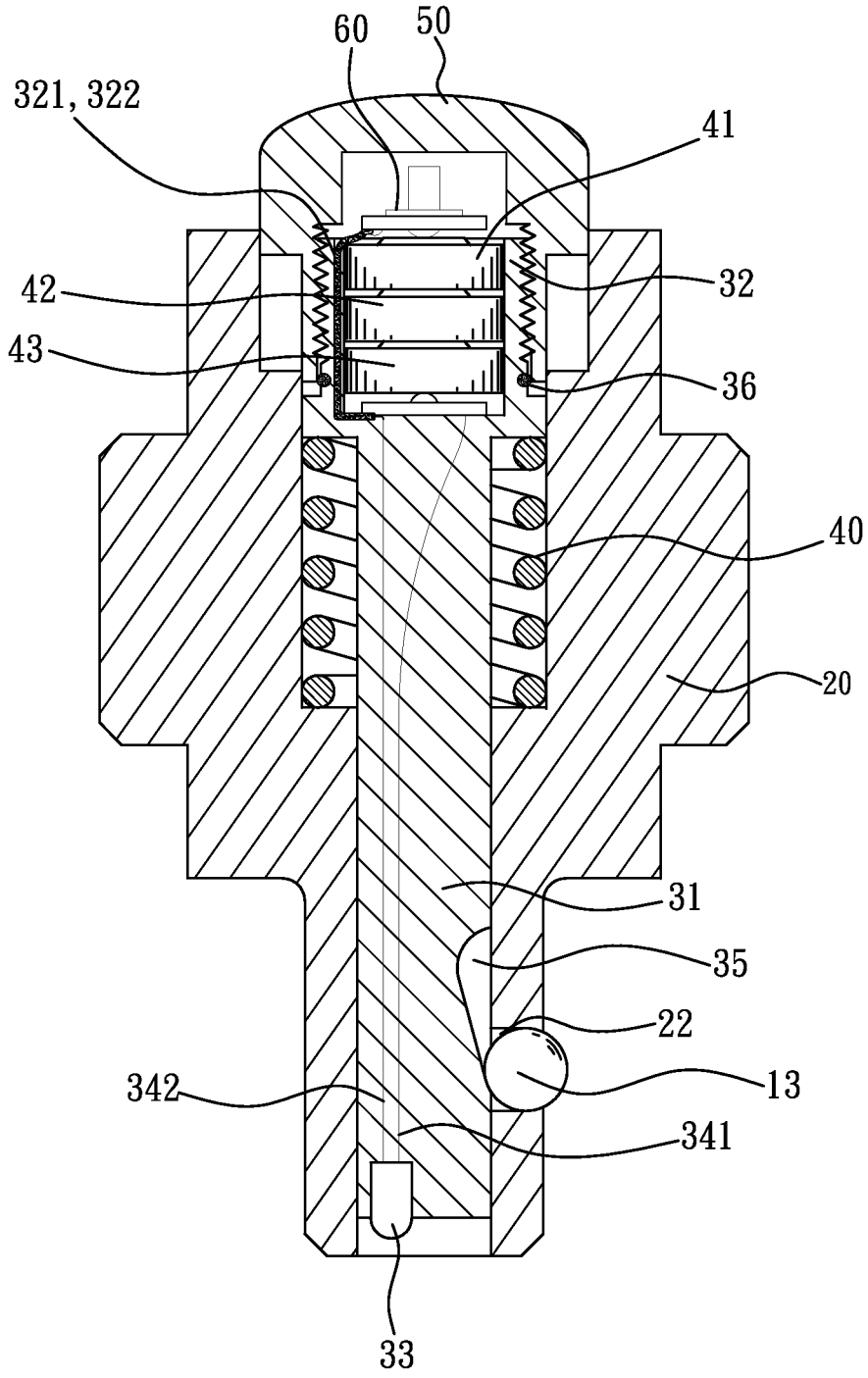
FIG. 4 shows a cross-sectional view of the driving shaft mechanism in the present invention.

Referring to FIG. 2 through FIG. 4, a perspective view, an exploded view and a cross-sectional view of the spindle assembly 10 in the present invention. Therein, the shaft 20 has a hollow through hole 2.1 and a positioning hole 22 at one lateral thereon.

The spindle 30 is mounted with the through hole 21 and includes a post 31 and a containing part 32. The post 31 has a lamp 33 and two electric pins 341, 342. The lamp 33 can be integrally formed inside the spindle 30 or placed at a hollow hole inside the spindle 30. The containing part 32 is a hollow chamber and has an open end opposite to the post 31. The containing part 32 is formed with a conductive recess 321 dented on one side wall thereof for holding a switching circuit 322. The electric pin 341 is electrically connected to an inner bottom of the containing part 32 while the other electric pin 342 is electrically connected to the switching circuit 322. A ball recess 35 is formed at one lateral of the post 31 for receiving the ball 13 corresponding to the positioning hole 22 located on the shaft 20 and an O-ring 36 is supplied outside the containing part 32.

The spring 40 is mounted outside the post 31 and positioned in the through hole 21 for providing a resilient force to the spindle 30, so as to allow the spindle 30 to slide axially along the through hole 21.

At least one battery 41, 42, or 43 is installed inside the containing part 32 with one electrode thereof electrically connected to the electric pin 341.

The spindle cap 50 is axially positioned over the containing part 32 and screwed on the open end of the containing part 32, thus allowing the spindle cap 50 to screw or unscrew with the open end; wherein, when being nonuse, the spindle cap 50 exposes atop the shaft; on the contrary; when being screwed, the spindle cap 50 drives the spindle 30 to slide along the through hole 21. In addition, the spindle cap 50 has an indicator 51 showing whether the switching circuit 322 is a close circuit (ON) or an open circuit (OFF), and by cooperation with the O-ring 36, the spindle cap 50 is tightly mounted with the containing part 32.

The switch 60 is set between atop the open end and the interior of the spindle cap 50 and is electrically connected with the switching circuit 322 and the other electrode of the battery 41, 42, or 43. The switch 60 may be a micro-switch or a push-switch. When being screwed, the spindle cap 50 rotates and presses on the switch 60, and in turn the switch 60 turns on the switching circuit 322 to generate electricity.

According to the above disclosure, by referring to the accompanying drawings, the following paragraphs explain the principle applied in the driving shall mechanism of the present invention.

When a user utilizes the ratchet wrench in the present invention to assemble or detach tool items such as a bushing, the user screws the spindle cap 50 so that the spindle 30 slides along the through hole 21. As the spindle 30 slides, a space between the ball recess 35 and the positioning hole 22 is formed to contain the ball 13 movably retreating so as to allow the spindle assembly 10 to be mounted with the bushing. When the user unscrews the spindle cap 50, the spring 40 provides a resilient force to the spindle 30 and a part of the ball 13 is forced to jut out of the positioning hole 22. The protruding portion of the ball 13 is engaging with the interior wall of the bushing mounted with the shaft 20 for fixing the bushing and the shall 20.

Figure 5:
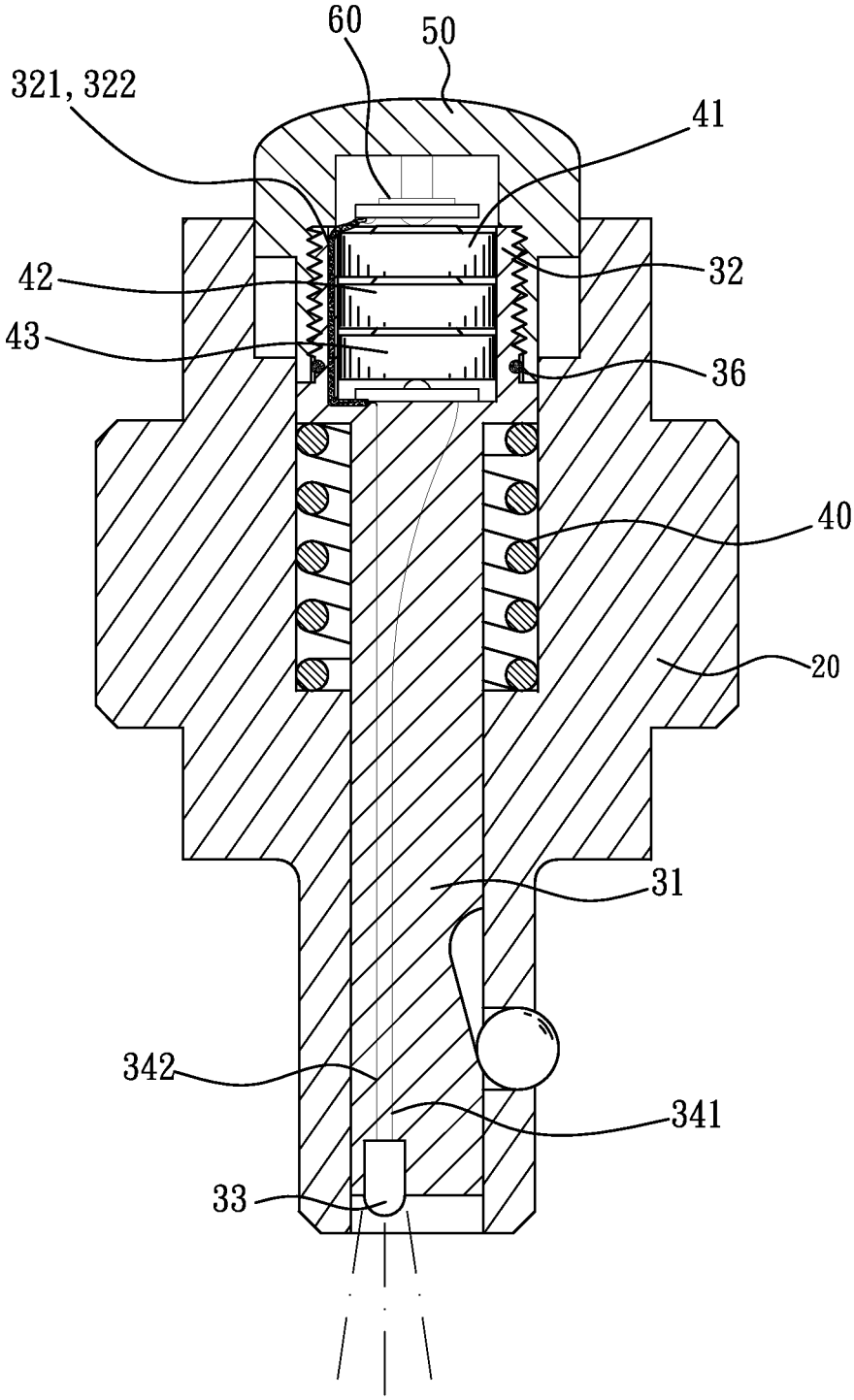

As shown in FIG. 5, when using the lamp 33, the user may rotate the spindle cap 50 in accordance with the indicator 51, and the spindle 30 rotates in one direction without shifting to the other direction by virtue of the ball recess 35 and the ball 13 of the spindle 30. Thus, when the user rotates spindle cap 50, the spindle cap 50 screws or unscrews with the open end of the containing part 32.

Therefore, when the user follows the indicator 51 and rotates the spindle cap 50 toward "ON", the spindle cap 50 screws on the open end of the containing part 32 so as to drive the spindle cap 50 to press on the switch 60, thereby closing the loop of the switching circuit 322 to generate a light from the lamp 33.

By the same token, when the user rotates the spindle cap 50 toward "OFF", the spindle cap 50 unscrews from the open end of the containing part 32 so as to withdraw the spindle cap 50 away from the switch 60, thereby creating opening the loop of the switching circuit 322 to turn off the light.

As above disclosed, the present invention offers said lighting device applied to the ratchet wrench that is effective in preventing an accidental switch-off which may result in danger in the course of operating the ratchet wrench on the strength of screwing and unscrewing motions between the spindle cap 50 and the containing part 32.

Figure 6:
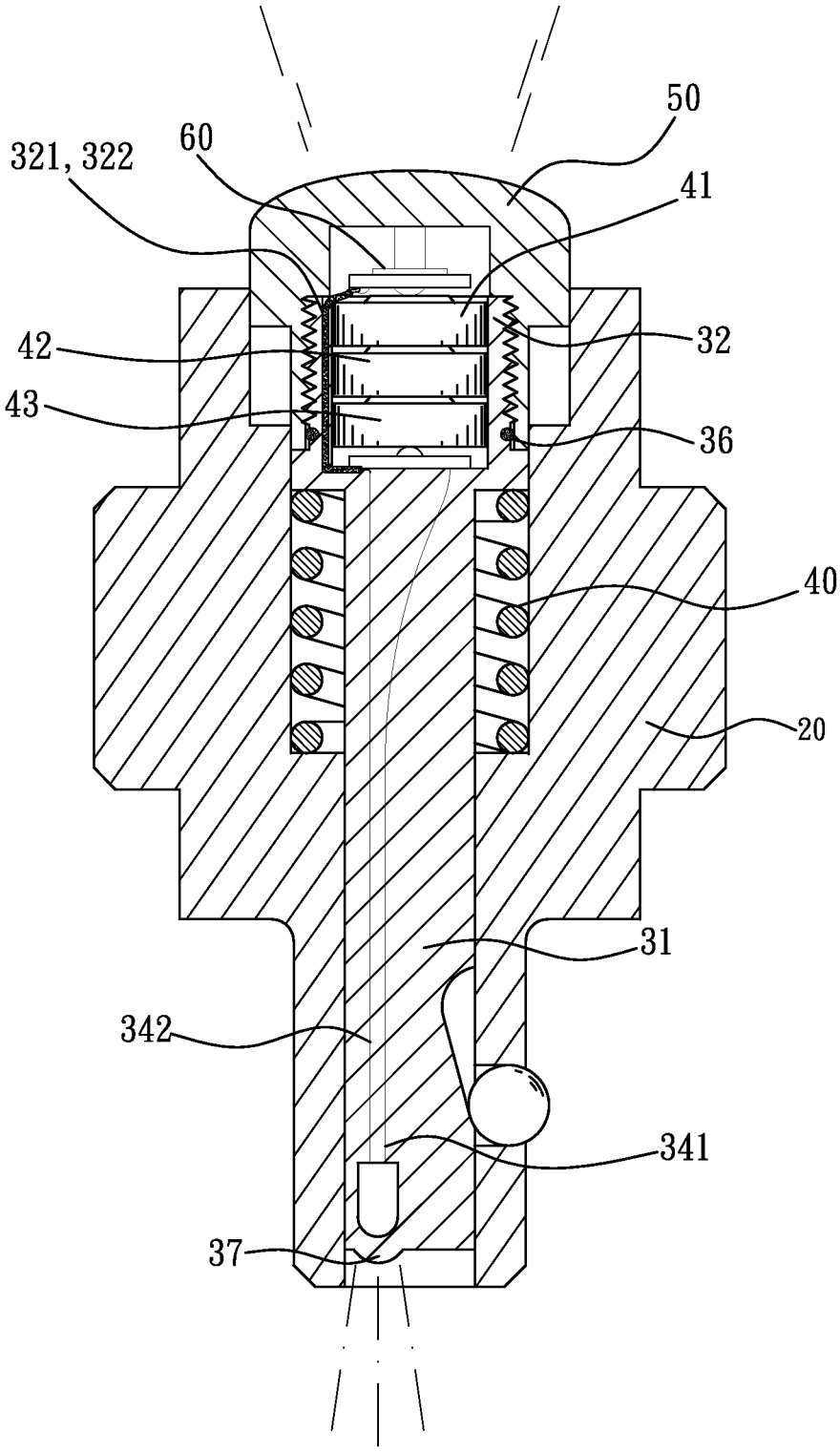

As depicted in FIG. 6, the spindle 30 may be made by a plastic material, thus allowing the spindle 30 to be formed integrally and further saving costs from cutting and drilling processes necessary for a metal material. Alternatively, the spindle 30 may be constituted by a transparent or light-transmitting material in order to form a lens structure 37 at one end facing the lamp 33, wherein the lamp 33 is located in the spindle 30, and it is convenient to change a light distribution pattern of the lamp 33. Furthermore, the spindle cap 50 may also be made with a transparent or light-transmitting material for rendering a light emitting effect in the spindle cap 50 and the spindle 30 by the virtue of refraction, so as to brighten up the indicator 51.

Having thus described several aspects of at least one embodiment of this invention, it is to be appreciated that various alterations, modifications, and improvements will readily occur to those skilled in the art. Such alterations, modifications, and improvements are intended to be part of this disclosure, and are intended to be within the spirit and scope of the invention rather than limit the scope of the present invention. Accordingly, the foregoing description and drawings are by way of example only.

What is claimed is:

1. A driving shaft mechanism for a ratchet wrench built as a spindle assembly of the ratchet wrench for driving an external fixing element to rotate in either direction and providing illumination, the driving shaft mechanism comprising:

a shaft having a hollow through hole therein and being configured to combine and thereby drive the external fixing element;

a spindle being installed in the through hole and having:

a post having a lamp and two electric pins attached to the lamp, and a containing part that defines a hollow chamber and has an open end opposite to the post and a conductive recess dented on one side wall of the containing part for accommodating a switching circuit, wherein the electric pins are electrically connected to an inner bottom of the containing part and the switching circuit, respectively;

a ball received in a ball recess dented on the lateral side of the post and one positioning hole is provided on the shaft corresponding to the ball;

a spring sleeved outside the post and retained in the through hole for providing a resilient force to the spindle in order to make the ball enter the ball recess or expose outside of the positioning hole in order to provide or not to provide the external fixing element;

at least one battery provided in the containing part that has one of two electrodes electrically connected with the electric pin that is connected to the inner bottom of the containing part;

a spindle cap which is axially positioned outside the containing part and exposes atop the shaft when being screwed on the open end of the containing part; and a switch being provided between the open end of the containing part and an interior of the spindle cap, and being electrically connected between the other electrode of the battery, wherein the spindle cap can screw on one open end of the containing part and thus produce axially movement, and the switching circuit to be pressed or released by the spindle cap, so as to control the switching circuit to turn on or off the lamp.

2. The driving shaft mechanism of claim 1, wherein the switch is a micro-switch or a push-switch.

3. The driving shaft mechanism of claim 1, wherein the spindle cap has an indicator showing whether the switching circuit is close or open.

4. The driving shaft mechanism of claim 1, wherein an O-ring is mounted around the containing part for allowing the spindle cap to be firmly combined with the containing part.

5. The driving shaft mechanism of claim 1, wherein the spindle is made of a plastic material.

6. The driving shaft mechanism of claim 5, wherein the spindle is made of a transparent or light-transmitting material.

7. The driving shaft mechanism of claim 6, wherein the lamp is installed inside the spindle.

8. The driving shaft mechanism of claim 6, wherein the spindle has a lens structure configured at one end thereof corresponding to the lamp.

* * * * *